US011174681B2

(12) United States Patent
Hardin, Jr.

(10) Patent No.: US 11,174,681 B2
(45) Date of Patent: Nov. 16, 2021

(54) PUSH-THE-BIT BOTTOM HOLE ASSEMBLY WITH REAMER

(71) Applicant: HALLIBURTON ENERGY SERVICES, INC., Houston, TX (US)

(72) Inventor: John Ransford Hardin, Jr., Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 35 days.

(21) Appl. No.: 16/616,750

(22) PCT Filed: Aug. 31, 2017

(86) PCT No.: PCT/US2017/049551
§ 371 (c)(1),
(2) Date: Nov. 25, 2019

(87) PCT Pub. No.: WO2019/045718
PCT Pub. Date: Mar. 7, 2019

(65) Prior Publication Data
US 2021/0148172 A1 May 20, 2021

(51) Int. Cl.
*E21B 7/06* (2006.01)
*E21B 10/26* (2006.01)

(52) U.S. Cl.
CPC ..... *E21B 7/064* (2013.01); *E21B 7/06* (2013.01); *E21B 10/26* (2013.01)

(58) Field of Classification Search
CPC ..... E21B 7/06; E21B 7/064; E21B 7/062
See application file for complete search history.

(56) References Cited

U.S. PATENT DOCUMENTS

| | | | | |
|---|---|---|---|---|
| 4,739,843 | A | 4/1988 | Burton | |
| 5,060,736 | A | 10/1991 | Neff | |
| 6,092,610 | A | 7/2000 | Kosmala et al. | |
| 7,513,318 | B2 * | 4/2009 | Underwood | E21B 7/067 175/61 |
| 8,141,657 | B2 | 3/2012 | Hutton | |
| 8,807,246 | B2 | 8/2014 | Lassoie et al. | |
| 2007/0102201 | A1 * | 5/2007 | Savignat | E21B 7/062 175/385 |
| 2007/0163810 | A1 * | 7/2007 | Underwood | E21B 17/20 175/61 |
| 2007/0205022 | A1 | 9/2007 | Treviranus et al. | |
| 2007/0251726 | A1 | 11/2007 | Menger | |
| 2015/0008043 | A1 | 1/2015 | Clausen et al. | |
| 2015/0101864 | A1 | 4/2015 | May | |

FOREIGN PATENT DOCUMENTS

WO WO 2016/060976 A1 4/2016

OTHER PUBLICATIONS

International Search Report and Written Opinion issued for International Application No. PCT/US2017/049551, ISA/KR, dated Feb. 27, 2018, 16 pages.

* cited by examiner

*Primary Examiner* — Cathleen R Hutchins

(57) ABSTRACT

A method for constructing a wellbore includes drilling a wellbore along a trajectory using a bit; reaming the diameter of a portion of the drilled wellbore to enlarge a portion of the wellbore; and altering the trajectory of the bit by applying a lateral force to the enlarged diameter wellbore. Reaming the diameter of the portion of the drilled wellbore increases the dogleg of the wellbore.

20 Claims, 6 Drawing Sheets

PUSH-THE-BIT BOTTOM HOLE ASSEMBLY WITH REAMER

CROSS-REFERENCE TO RELATED APPLICATION

The present application is a U.S. National Stage patent application of International Patent Application No. PCT/US2017/049551, filed on Aug. 31, 2017, the benefit of which is claimed and the disclosure of which is incorporated herein by reference in its entirety.

TECHNICAL FIELD

The present disclosure relates generally to a method of drilling a wellbore, and specifically, to a method of enlarging the diameter of the wellbore using a push-the-bit bottom hole assembly having a reamer to increase a dogleg capability, reduce wellbore tortuosity, and/or reduce forces and stresses on the bottom hole assembly and/or drill string.

BACKGROUND

Directional drilling operations involve controlling the direction of a wellbore as it is being drilled. Generally, the goal of directional drilling is to reach a target subterranean destination with a drill string, and often the drill string will need to be turned through a tight radius to reach the target destination. Generally, a rotary steerable system, which forms a portion of a bottom hole assembly ("BHA"), is used to steer the bottom hole assembly to create a curved section of the wellbore. Each BHA has a maximum dogleg capability. There are instances when the maximum dogleg capability of a BHA is not sufficient. For example, the BHA, even when operated at its maximum dogleg capability may produce a dogleg less than a desired dogleg. This may be due to the type of formation being drilled; a tool problem; drill bit walk tendencies; when the geology of interest is not at the depth expected and a quick response is desired; or when sudden changes in geology are encountered, such as faults. Directional drilling can also result in a reduction of weight transfer to the drill bit due friction forces being generated when the drill string contacts a wall of a curved section of the wellbore.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure are described below as they might be employed using a push-the-bit type assembly with reamer. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

Figure 1A:
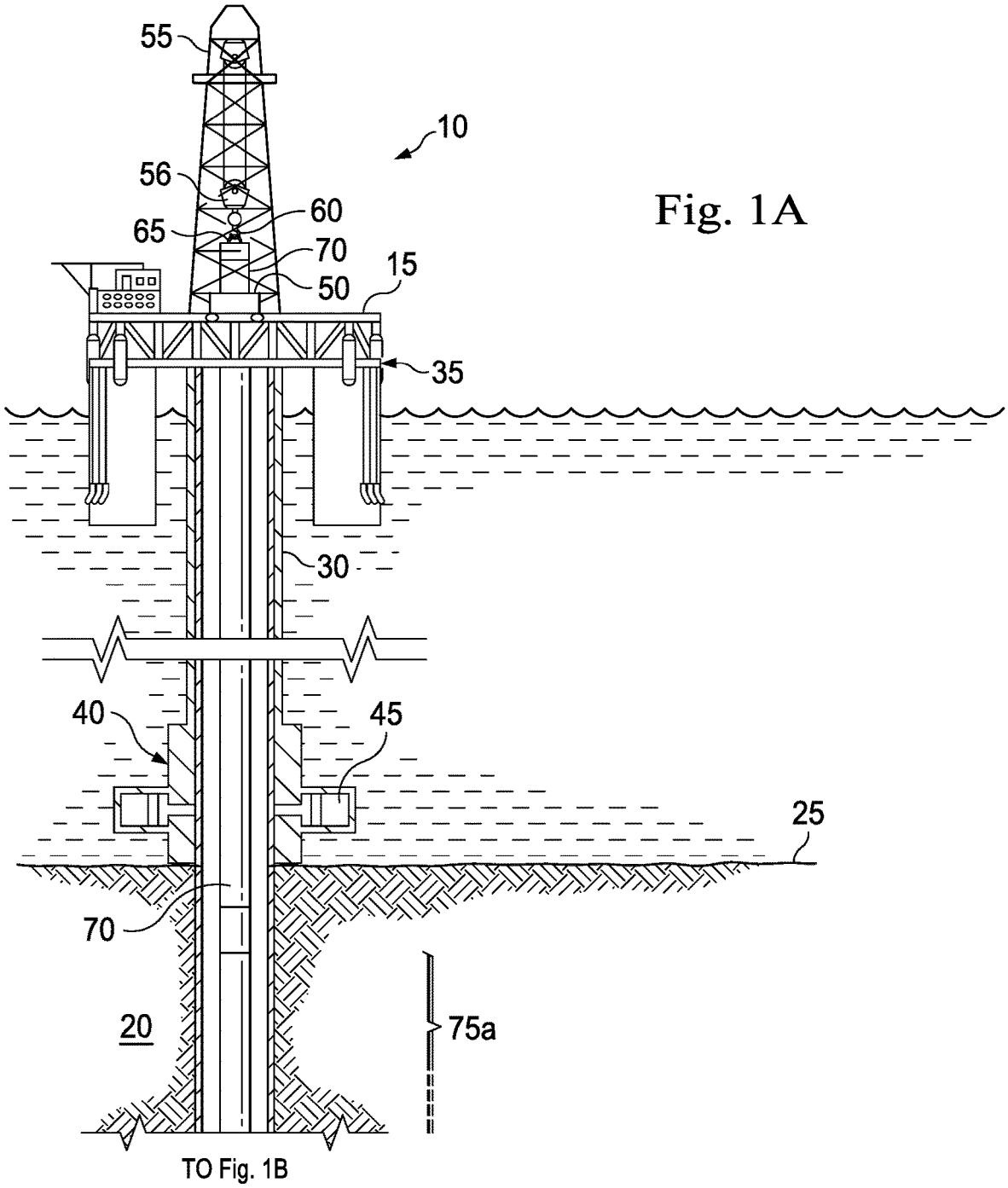
FIGS. 1A and 1B together form a schematic illustration of an offshore oil and gas platform operably coupled to a push-the-bit type assembly with reamer, according to an exemplary embodiment of the present disclosure.
Figure 1B:
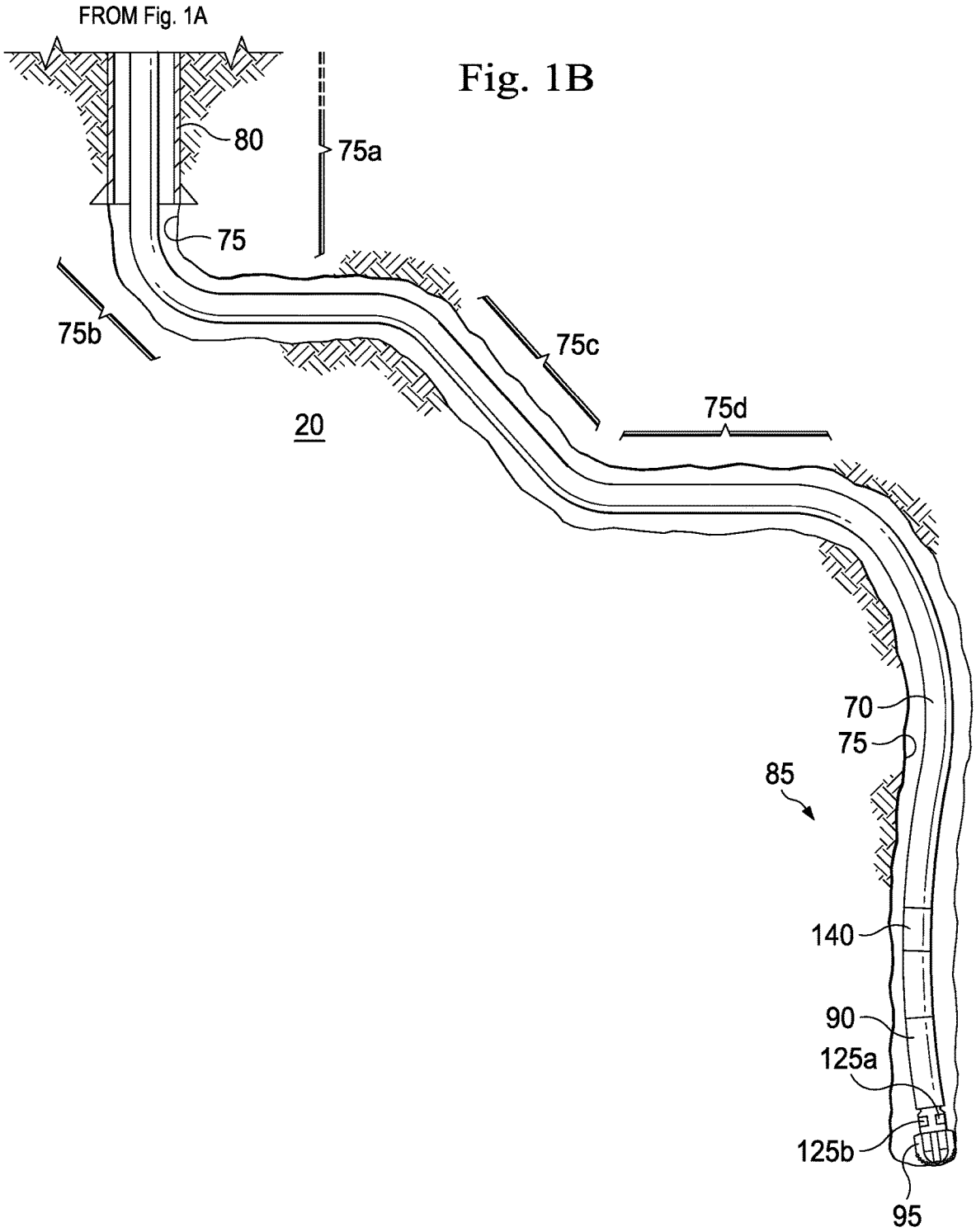

Referring to FIGS. 1A and 1B, a push-the-bit type assembly with reamer that is extending a wellbore from an offshore oil or gas platform that is schematically illustrated and generally designated 10. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending drill string 70. A wellbore 75 extends through the various earth strata including the formation 20, with some portions of the 75 having a casing string 80 cemented therein. However, in some embodiments the entirety of the wellbore 75 may be an open hole wellbore.

The wellbore 75 includes any one or more of a vertical section 75*a*, a curved section 75*b*, a tangent section 75*c*, and a horizontal section 75*d*. The wellbore 75 may be an uphill wellbore and/or include multilateral wellbores. Accordingly, it should be understood by those skilled in the art that the use of directional terms such as "above," "below," "upper," "lower," "upward," "downward," "uphole," "downhole", "up", "down", "left", "right" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. "Up" and "down" apply on a plane at the downhole end of a drill bit perpendicular to the longitudinal axis of the wellbore; "up" being in line with but oriented against the gravity vector projected on this plane; "down" being in line with and oriented with the gravity vector projected on this plane. "Left" and "right" apply on the same plane but in directions perpendicular to the projected gravity vector as viewed looking downhole. Also, even though FIGS. 1A and 1B depict an offshore operation, it should be understood by those skilled in the art that the apparatus according to the present disclosure is equally well suited for use in onshore operations.

Figure 2:
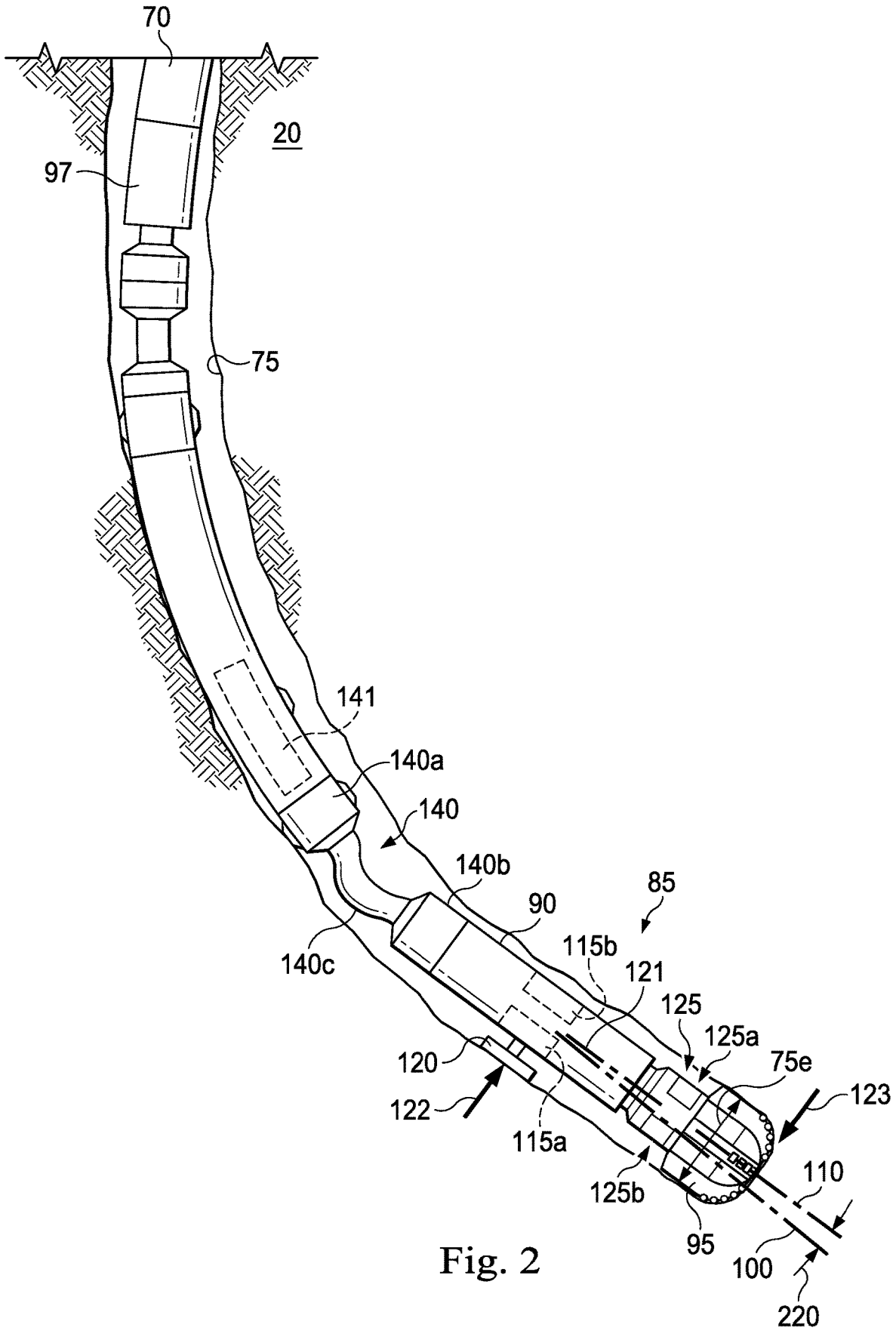
FIG. 2 is a schematic illustration of a portion of the push-the-bit type assembly with reamer of FIG. 1 in a first configuration, according to an exemplary embodiment of the present disclosure.

A push-the-bit type assembly with reamer, or BHA 85, is coupled to the lower or distal end of the drill string 70. FIG. 2 illustrates the BHA 85 coupled to a distal end of the drill string 70. The BHA 85 may include a rotary steerable tool 90 and a drill bit 95 that may be rotationally fixed relative to the drill string 70, such that the rotary steerable tool 90 and the drill bit 95 rotate with the same speed and direction as the drill string 70. In other instances, the rotary steerable tool 90 maintains a geo-stationary position with respect to the wellbore 75 as the drill string 70 and drill bit 95 rotate at the same speed. In some instances, a straight mud motor 97 may be placed in the BHA 85 directly above the rotary steerable tool 90, or at the top of the BHA 85, or anywhere in between to provide extra torque and rotational speed to the drill bit 95. With mud motor 97 above rotary steerable tool 90, the rotary steerable tool 90 and drill bit 95 may rotate at a speed faster than the drill string 70. In other instances, the rotary steerable tool 90 may maintain a geo-stationary position with respect to the wellbore 75, but the drill bit 95 will still rotate faster than the drill string 70. In certain embodiments, the BHA 85 includes additional tools, such as a measurement-while-drilling (MWD) apparatus.

In certain embodiments, the BHA 85 includes the drill bit 95 coupled to the rotary steerable tool 90 directly or via one or more tools. The rotary steerable tool 90 imparts rotation from the drill string 70 to the drill bit 95. As the drill string 70 rotates, the downhole end of the rotary steerable tool 90 and the drill bit 95 may rotate at the same speed and direction as the drill string 70. The downhole end of the rotary steerable tool 90 and the drill bit 95 may rotate about a longitudinal axis 100 of the drill bit 95 that may be different than a longitudinal axis 110 of the wellbore 75 at the downhole end. In the embodiment shown, a drilling direction of the drill bit 95, or toolface, may have two components on a plane perpendicular to a longitudinal axis 110 of the wellbore 75 at the downhole end of the wellbore 75: an up or down component of side force reacted at the drill bit 95 cutting structure; and a left or right component of side force reacted at the drill bit 95 cutting structure.

According to aspects of the present disclosure, the rotary steerable tool 90 may include at least one actuator. The embodiment shown includes a plurality of actuators 115 coupled to the rotary steerable tool 90. As will be described below, the actuators 115 may be selectively and independently triggered as the rotary steerable tool 90 rotates to cause the drill bit 95 side force (e.g., one of up/down and one of left/right) to correspond to a desired drilling direction. For example, the actuators 115 may alter or maintain the drill bit side force components in the up/down and left/right directions and/or may maintain the drill bit 95 in a relatively straight forward path with respect to the wellbore 75 as the drill string 70 rotates. The actuators 115 may take a variety of configurations—including electromagnetic actuators, piezoelectric actuators, hydraulic actuators, etc.—and be powered through a variety of mechanisms. The actuators 115*a* 115*b*, and 115*c* (115*c* shown in FIG. 3), which in some embodiments are circumferentially spaced by about 120 degrees, may include pads or blades 120 that contact a wall of the wellbore 75 when triggered. A pad may include a blade or other tool that contacts the wall of the wellbore 75. That is, the actuators 115 and thus the pads 120 are configured to extend radially in a direction perpendicular to a longitudinal axis 121 of the rotary steerable tool 90. By contacting the wall of the wellbore 75, the pad 120 may apply a force 122 to the side of the rotary steerable tool 90 that is reacted as a side force 123 at the drill bit 95 cutting structure. As drilling progresses, the side force 123 reacted by the drill bit 95 is substantially relieved as a deviated wellbore 75 is drilled in the desired direction. The pad force is subsequently reacted at other contact locations with the wellbore 75, such as at stabilizer or wear pad locations, or creates bending moments in BHA 85 that has to traverse a deviated wellbore 75. The force 122 from pad 120 and reaction force 123 at the drill bit 95 may create an offset angle 220 between the longitudinal axis 110 of the wellbore and the longitudinal axis 100 of the drill bit. The size of the offset angle 220 may be a function of the amount of lateral deflection of the rotary steerable tool 90 relative to the wellbore 75 caused by the actuators 115*a*, 115*b*, and 115*c* and pads 120 acting on wellbore 75. The offset angle 220 is shown as a negative tilt angle of the longitudinal axis 100 of drill bit 95 relative to the longitudinal axis 110 of wellbore 75, meaning the drill bit is pointing outside the curvature of the deviated wellbore 75. As drilling progresses, weight-on-bit acting with the negative tilt angle 220 of the drill bit 95 will tend to straighten the curvature of deviated wellbore 75. The side force 123 reacted by the drill bit 95 acts with the side cutting capability of the drill bit 95 to compensate and create additional curvature of deviated wellbore 75 up to the maximum dogleg capability of the BHA 85. Accordingly, the actuators 115*a*, 115*b*, and 115*c* may be triggered to control the up and down direction components of the drill bit 95. Likewise, the left or right orientation of the actuators 115*a*, 115*b*, and 115*c* when they are triggered may control the left or right direction components of the drill bit 95.

Figure 3:
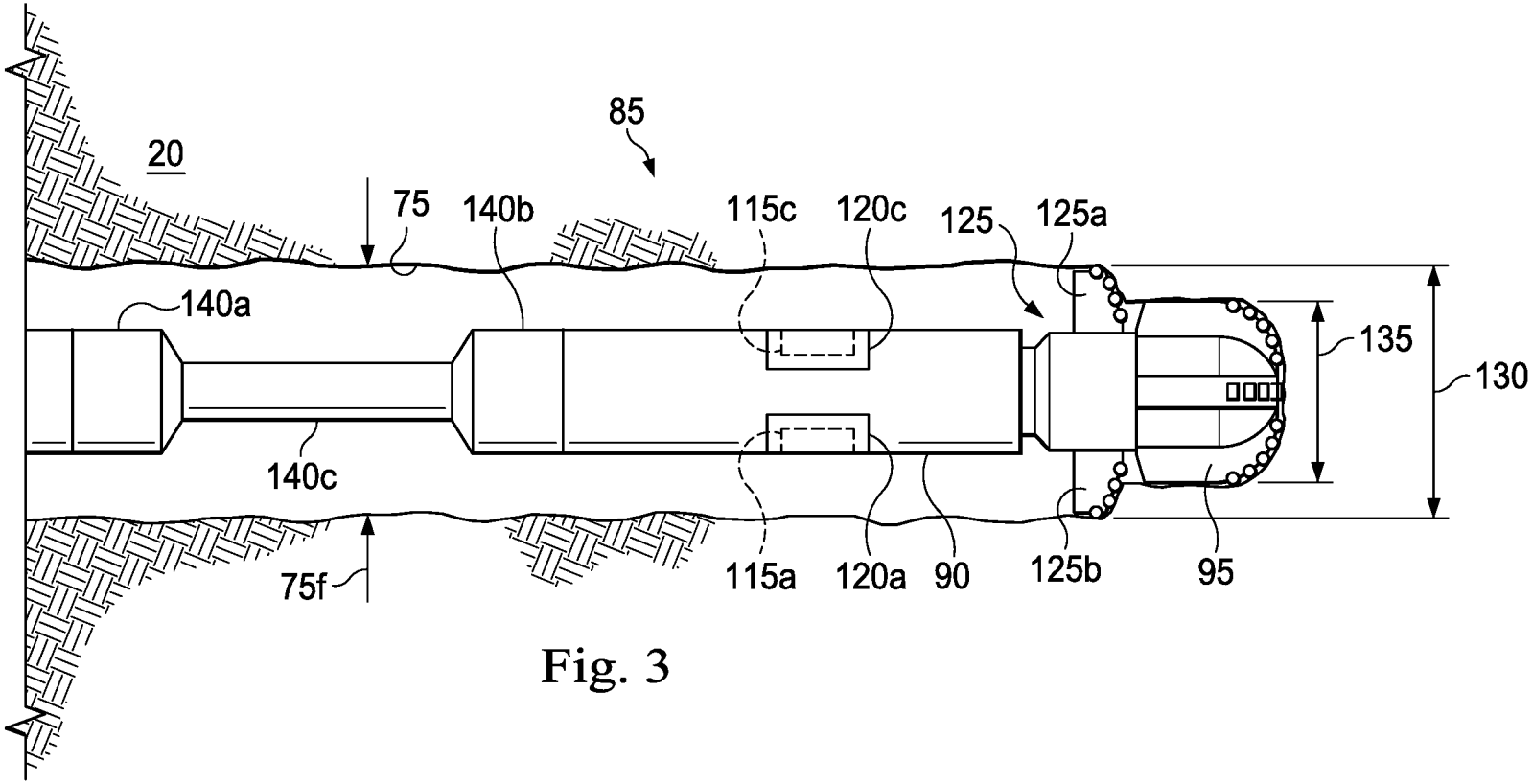
FIG. 3 is a schematic illustration of a portion of the push-the-bit type assembly with reamer of FIG. 1 in a second configuration, according to an exemplary embodiment of the present disclosure.
Figure 5:
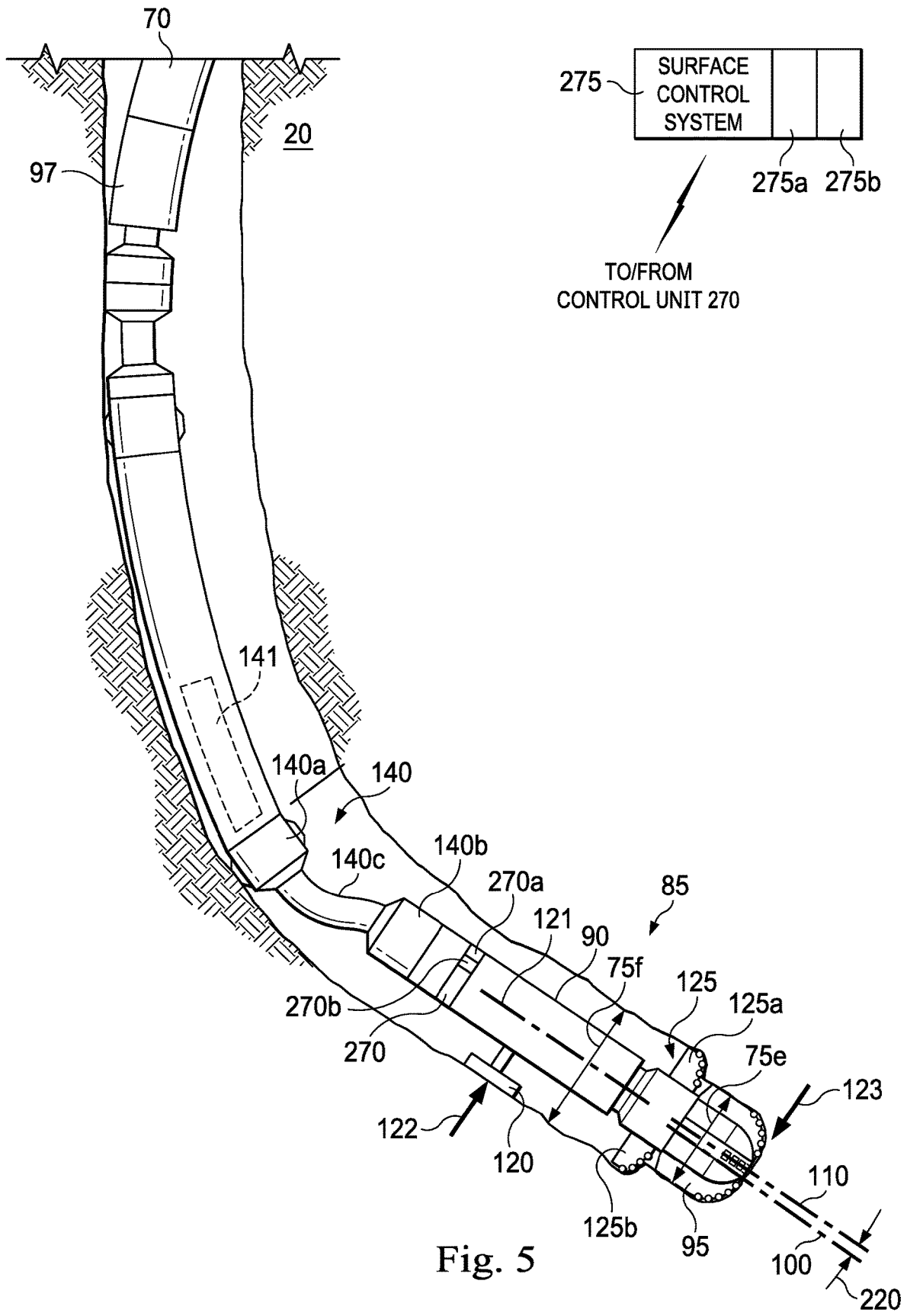
FIG. 5 is schematic illustration of the push-the-bit type assembly with reamer of FIG. 1 during a step of the method of FIG. 4, according to an exemplary embodiment of the present disclosure.

The BHA 85 also includes a reamer 125 that is positioned between the drill bit 95 and the rotary steerable tool 90. This positioning "between" includes the reamer 125 being built into or forming a portion of the drill bit 95, and thus positioned below the rotary steerable tool 90; the reamer 125 being built into or forming another tool that is positioned between the drill bit 95 and the rotary steerable tool 90; and the reamer 125 being built into a lower end of the rotary steerable tool 90. Generally, the reamer 125 is positioned below, or downhole from, the pads 120 of the rotary steerable tool 90. The reamer 125 may be any wellbore diameter enlargement device and may be a single actuation reamer or a multi-actuation reamer such that the reamer 125 can be activated and deactivated multiple times. FIG. 2 is an illustration of the BHA 85 and the drill string 70 extending in the wellbore 75. As shown in FIG. 2, the reamer 125 is in a first configuration such that reamer cutting structures 125*a* and 125*b*, which are capable of extending radially in a direction perpendicular to a longitudinal axis of the reamer 125, are in a retracted position. While only two reamer cutting structures 125*a* and 125*b* are shown in FIGS. 2, 3, and 5, the reamer 125 may include any number of reamer cutting structures spaced circumferentially and/or longitudinally along the reamer 125. When in the first configuration (e.g., not activated), the reamer cutting structures 125*a* and 125*b* are retracted and spaced from the wall of the wellbore 75 such that the reamer 125 does not enlarge the diameter of the wellbore 75.

The BHA 85 may also include a flexible collar 140 or include a flexible section that is coupled uphole from the rotary steerable tool 90. Generally, the flexible collar 140 is positioned along the BHA 85 such that the rotary steerable tool 90 is coupled between the drill bit 95 and the flexible collar 140. The flexible collar 140 generally has a lower bending stiffness than the rotary steerable tool 90 and other BHA components. In some embodiments, the flexible collar 140 includes a structural connector, threads, latches, etc. at leading or downhole end thereof for selectively coupling to a trailing or uphole end of the rotary steerable tool 90. A control section and a flow control section of the BHA 85 along with the steering section (i.e., the rotary steerable tool 90) is packaged in a single housing with a greater bending stiffness than the flexible collar 140 in some instances. The flexible collar 140 may include a drill string coupler 140*a* and wear band at an uphole end thereof for coupling to an uphole portion of the BHA 85 and another coupler 140*b* on an opposing end to couple to the downhole portion of the BHA 85. Between the couplers 140*a* and 140*b*, a flex section 140*c* extends that is capable of buckling or bending. As such, the BHA 85 exhibits greater flexibility than the rotary steerable tool 90 alone. In some embodiments, the flexible collar 140 is more flexible (i.e., has a lower Modulus of Elasticity (E), or a smaller outer diameter) than other portions of the BHA 85 such that bending moment within the BHA 85 is reduced when the flexible collar 140 bends or buckles. That is, the flexible collar 140 has a lower bending stiffness than the rotary steerable tool 90. The flexible collar is sized and is composed of materials to increase or maximize the dogleg capability when desired, e.g., to drill a high DLS build, curve, drop or turn section of a wellbore. In some instances, the flexible collar 140 is a generally cylindrical tubular member, a traditional necked down collar section, or a fully articulated universal joint.

In some embodiments, the BHA 85 also includes a modular control and sensor section, or instrument collar, 141 with a control stabilizer. While the instrument collar 141, the flexible collar 140, and the rotary steerable tool 90 are illustrated in FIGS. 2 and 5 as separate elements, the rotary steerable tool 90 includes the instrument collar 141 and the flexible section 140. In some embodiments, the instrument collar 141 may be positioned downhole from the flexible section 140 or anywhere along the BHA 85.

FIG. 3 illustrates the reamer 125 in a second configuration. When activated or when in a second configuration, the reamer cutting structures 125*a* and 125*b* extend radially to contact the wall of the wellbore 75 and enlarge the diameter of the wellbore 75. Thus, when activated, the reamer 125 has an outermost diameter 130. In an exemplary embodiment, the outermost diameter 130 is greater than an outer diameter 135 of the drill bit 95.

Figure 4:
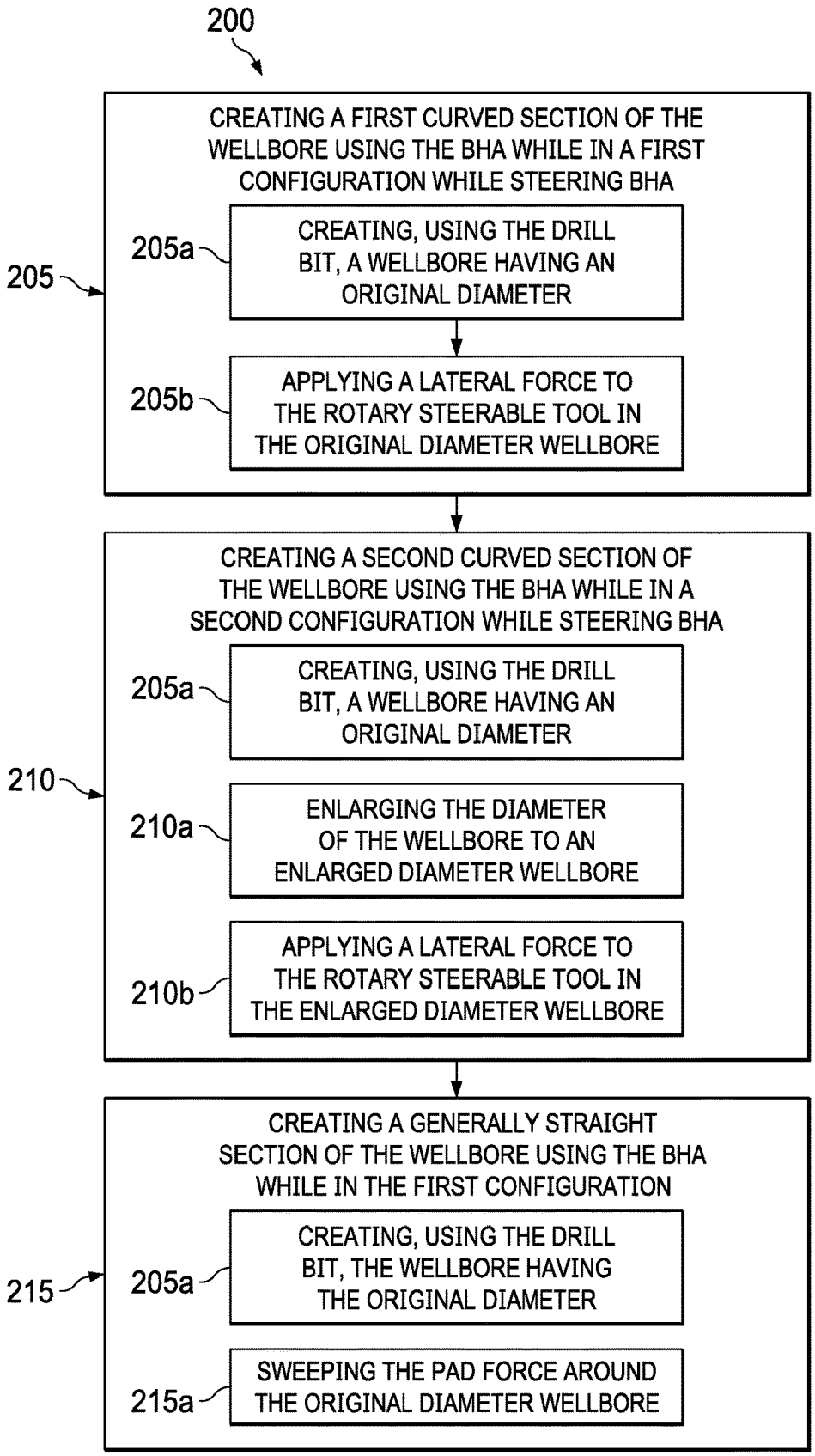
FIG. 4 is a flow chart illustration of a method of operating the push-the-bit type assembly with reamer of FIG. 1, according to an exemplary embodiment of the present disclosure.

In an exemplary embodiment, as illustrated in FIG. 4 with continuing reference to FIGS. 1A, 1B, 2, and 3 a method 200 of extending the wellbore 75 includes creating a first curved section of the wellbore 75 using the BHA 85 while the BHA 85 is in the first configuration while steering the BHA 85 at step 205; creating a second curved section of the wellbore 75 having a greater dogleg than the first curved section using the BHA 85 while the BHA 85 is in the second configuration while steering the BHA 85 at step 210; and creating a straight section (e.g., vertical, tangent, horizontal, lateral section) of the wellbore 75 using the BHA 85 while the BHA 85 is in the first configuration at step 215.

The step 205 includes the sub steps of creating, using the drill bit 95, the wellbore 75 having an original diameter illustrated by the dimension having the reference numeral 75*e* in FIG. 2 at step 205*a* and applying the force 122 to the side of the rotary steerable tool 90 that is reacted as the side force 123 at the drill bit 95 cutting structure, using the pad 120, in the original diameter 75*e* wellbore at step 205*b*. Referring back to FIG. 2, FIG. 2 illustrates the BHA 85 in the first configuration and drilling a curved section of the wellbore 75 while steering of the BHA 85 or at least the drill bit 95. To create the first curved section of the wellbore 75, the drill bit 95 creates a portion of the wellbore 75 having the original diameter 75*e* that generally corresponds to the diameter 135 of the drill bit 95. In some embodiments, the original diameter 75*e* is not equal to the diameter 135 of the drill bit 95, but at least a function of the diameter 135. As the reamer 125 of the BHA 85 is placed or remains in the first configuration, the reamer cutting structures 125*a* and 125*b* are retracted such that the reamer cutting structures 125*a* and 125*b* do not enlarge the original diameter 75*e* of the wellbore 75. At the step 205*b*, the actuators 115 trigger the pads 120 to contact the original diameter 75*e* of wellbore 75 and apply a side force 122 to rotary steerable tool 90 that creates the reaction side force 123 on the cutting structure of the drill bit 95. The flex section 140*c* buckles (i.e., bends or otherwise articulates) to make contact with wellbore 75*e* at coupler 140*a*, allowing a certain amount of offset angle 220 between the longitudinal axis 110 of the downhole end of wellbore 75*e* and the longitudinal axis 100 of the drill bit 95. The offset angle 220 is typically a negative tilt angle, meaning the drill bit 95 is pointing outside the curvature of the wellbore 75. That is, the drill bit 95 is pointed towards a trajectory having a radius of curvature greater than the curvature of the wellbore 75. A positive tilt angle is created when the drill bit 95 is pointing inside the curvature of the wellbore 75, or when the drill bit 95 is pointed towards a trajectory having a radius of curvature smaller than the curvature of the wellbore 75. As drilling progresses forward, the drill bit 95 creates a deviated wellbore 75 that is generally at the maximum dogleg capability associated with BHA 85 in the original diameter 75*e* of wellbore 75. Generally, the steps of 205*a* and 205*b* occur simultaneously.

When it is desired to increase the dogleg capability of the BHA 85, the reamer cutting structures 125*a* and 125*b* are deployed or activated such that the reamer 125 is in the second configuration to enlarge the original wellbore 75*e* to an enlarged diameter illustrated by the dimension having numeral 75*f* in FIGS. 3 and 5, with the enlarged diameter 75*f* being greater than the original diameter 75*e*. As the amount of increased dogleg capability is related to the amount of wellbore "overage" or difference between the enlarged diameter 75*f* and the original diameter 75*e*, the outermost diameter 130 of the reamer 125 while in the second configuration is sized to create the desired increase. In some embodiments, the reamer cutting structures 125*a* and 125*b* are capable of extending to one of a plurality of radial distances from the reamer 125 such that the reamer 125 is capable of enlarging the diameter of the wellbore to different diameters.

The step 210 includes the sub steps of the step 205*a*, enlarging the diameter of the wellbore 75 to the enlarged diameter 75*f* at step 210*a*, and applying the force 122 to the side of the rotary steerable tool 90 at step 210*b* that is reacted as the side force 123 at the drill bit 95 cutting structure. Generally, the steps of 205*a*, 210*a*, and 210*b* occur simultaneously. FIG. 5 illustrates the BHA 85 in the second configuration and drilling a curved section of the wellbore 75 while steering the BHA 85. The drill bit 95 creates a portion of the wellbore 75 having the original diameter 75*e* that generally corresponds to the diameter 135 of the drill bit 95 at the step 205*a*. At the step 210*a*, the reamer cutting structures 125*a* and 125*b* enlarge the diameter of the wellbore 75 from the original diameter 75*e* to the enlarged diameter 75*f*. At the step 210*b*, as drilling progresses forward and the wellbore is enlarged the actuators 115 trigger pads 120 to contact the enlarged diameter 75*f* of wellbore 75, causing the reactive side force 123 on the cutting structure of drill bit 95 to steer the drill bit 95 in the desired direction or drilling direction. The upper end of the flex section 140*c* of rotary steerable tool 90 may buckle or articulate to make contact with enlarged wellbore 75*f* at the coupler 140*a*. The maximum lateral displacement at the upper end of the flex section 140, or at the coupler 140*a*, is greater in the enlarged wellbore 75*f* than in original wellbore 75*e*. This extra displacement, allows offset angle 220 between the longitudinal axis 110 of the downhole end of wellbore 75*e* and the longitudinal axis 100 of the drill bit 95 to be less negative than the offset angle 220 in the original diameter wellbore 75*e*. That is, the negative tilt angle 220 is reduced and in some instances reduced such that the offset angle 220 becomes a positive tilt angle. Weight-on-bit acting with a less negative, or positive, offset angle 220 helps the side force 122 reacted by the drill bit 95 to act with the side cutting capability of the drill bit 95 to create additional curvature of wellbore 75*f*. The drill bit 95 generally creates a deviated wellbore with a larger dogleg capability due to the enlarged wellbore 75*f* than is possible in the original diameter wellbore 75*e*. Deliberately enlarging the diameter of the wellbore 75 provides more displacement of the pads 120. That is, the pads 120 can extend further away from the tool 90 when the tool 90 passes through the enlarged diameter wellbore 75*f* than when the tool 90 passes through the original diameter wellbore 75. This is acceptable up to the physical limit of extension of pads 120.

In an exemplary embodiment, when the enlarged diameter 75*f* is approximately 0.125 inches larger than the original diameter 75*e*, the actual dogleg capability is approximately 1 deg/100 ft. greater than the maximum dogleg capability of the BHA 85 in the original wellbore diameter 75*e*. Thus, during the step 210, the BHA 85 creates a second curved section having a radius of curvature that is less than the radius of curvature associated with the first curved section. That is, the second curved section has a greater dogleg than the first curved section.

In order to drill a relatively straight wellbore, the step 215 includes the sub steps of the steps 205*a*, and sweeping the pad or pads 120 that see the force 122 from actuator or actuators 115 around the wellbore in the original diameter wellbore 75*e* at step 215*a* such that the pad force 122 is never stationary in one orientation. FIGS. 1A and 1B illustrate the BHA 85 while in the first configuration while drilling a generally straight section of the wellbore 75. As previously noted, the drill bit 95 creates a portion of the wellbore 75 having the original diameter 75*e* that corresponds to the diameter 135 of the drill bit 95 at the step 205*a*. When drilling a straight section of the wellbore, the original diameter 75*e* of the wellbore 75 not only corresponds to the diameter 135 of the drill bit 95, but may be dependent upon other factors as well such as for example distance between the drill bit 95 and the rotary steerable tool 90, etc. The reamer cutting structures 125*a* and 125*b* are retracted during the step 205*a*. At the step 215*a*, the orientation of the force 122 on pads 120 is swept around the wellbore 75 as the drill string 70 and the BHA 85 (including rotary steerable tool 90 and the drill bit 95) rotate. In one embodiment, the rotary steerable tool 90 does not rotate but the drill bit 95 does. In another embodiment, the mud motor 97 is placed in the BHA 85 above the rotary steerable tool 90 such that the rotary steerable tool 90 and the drill bit 95 rotate faster than the drill string 70. In another embodiment with the mud motor 97 placed in the BHA 85 above the rotary steerable tool 90, the rotary steerable tool 90 does not rotate, but the drill bit 95 rotates faster than the drill string 70. The orientation of the force 122 on pads 120 can be swept around the wellbore 75 at the same speed as the drill bit 95, slower than drill bit 95, faster than drill bit 95, and even in the opposite rotary direction. Additionally, the orientation of the force 122 on pads 120 can be swept back and forth in an arc to achieve a relatively straight wellbore or to reduce effective dogleg capacity. Generally, the steps of 205*a* and 215*a* occur simultaneously during rotational drilling to create a straight section (i.e., tangent, horizontal, vertical, or lateral) section of the wellbore 75. At the steps 205 and 215, and when the increased dogleg capability associated with an enlarged diameter 75*f* is not needed, such as drilling straight or steering with a reduced dogleg, the reamer 125 is in the first configuration, reducing dogleg capability. Reduced dogleg capability leads to improved steering control, less wellbore tortuosity and less wellbore curvature. These features reduce forces and stress on the drill bit 95, the rotary steerable tool 90, and other tools within the BHA 85 such as stabilizers, pads, etc. Weight transfer to the drill bit 95 is also improved due to the reduction in friction from the reduced contact forces, which enables longer horizontal/lateral sections of the wellbore 75.

Use of the BHA 85 and/or the method 200 allows for increased dogleg capability when necessary, but otherwise reduces friction from the reduced contact forces between a wall of the wellbore and the BHA 85 and/or the drill string 70, which improves the weight transfer to the drill bit 95 and enables longer horizontal/lateral sections of the wellbore 75. Wellbore tortuosity is also decreased with the lower dogleg capability (i.e., when the reamer 125 is in the first configuration), which better enables the casing and completion equipment to be run downhole.

The BHA 85 and/or the method 200 results in the ability to have a high dogleg capability for the curved section 75*b* of the wellbore 75 and a reduced dogleg capability for straighter sections of the wellbore 75 thereby creating a multi-dogleg-capability BHA 85. The multi-dogleg-capability BHA 85 reduces equipment failures, non-productive time, and potentially the loss of a well. The multi-dogleg-capability BHA 85 reduces frictional drag, which improves weight transfer to the drill bit 95, which in turn supports drilling ahead, drilling long tangent or horizontal/lateral sections beyond the curve, and running casing and completions equipment. Generally, wellbore tortuosity creates higher contact forces with the BHA 85 and drill string 70, increases frictional drag, and inhibits weight transfer to the drill bit 95. This, in turn, can impede drilling ahead, drilling long tangent or horizontal/lateral sections beyond the curve, and running casing and completions equipment. Use of the BHA 85 and/or the method 200 reduces the wellbore tortuosity.

Deliberately enlarging the wellbore 75 at or near the drill bit 95 to increase dogleg capability when needed is useful in many situations. Higher dogleg capability is typically needed to drill the curved section 75*b* of a wellbore 75 compared to other sections of the well bore such as vertical, tangent, and horizontal. Using the BHA 85 to deliberately enlarge the diameter of the wellbore 75 at or near the drill bit 95 allows the curved section 75*b* of the wellbore 75 to be drilled at the desired, higher dogleg. This is in part because the flexible collar 140 reduces the bending moment exerted or applied to each of the rotary steerable tool 90 and the drill bit 95, thereby allowing the side force 123 to more effectively steer the drill bit 95 instead of trying to overcome the forces pushing the drill bit 95 in a trajectory that is outside the curvature of the desired wellbore curvature. Other sections of the wellbore 75 that require lower dogleg capability (i.e., sections 75*a*, 75*c*, 75*d*, etc.) would be drilled without deliberately enlarging the diameter of the wellbore 75. The lower dogleg capability (e.g., when the reamer 125 is in the first configuration) reduces forces and stress on the drill bit 95, rotary steerable tool 90, mud motor, stabilizers, pads, etc. for the majority of the wellbore.

Other situations where increased dogleg capability on demand may be needed are: when the rotary steerable tool 90 is not generating the dogleg expected, perhaps due to the formation being drilled, or a tool problem or to counter drill bit walk tendencies; or if the geology of interest is not at the depth expected and a quick response is desired; or sudden changes in geology are encountered, such as faults.

In some embodiments, the BHA 85 and/or the method 200 reduces the number of bitruns for each well, as the BHA 85 is capable of creating a variety of segments of the well (e.g., the vertical section 75*a*, the curved section 75*b*, the tangent section 75*c*, the horizontal section 75*d*) while reducing stresses on the BHA 85 and reducing wellbore tortuosity.

Any variety of wellbore diameter enlarging tools can be used in place of the reamer 125. In some cases, a single activation of the reamer 125 may be acceptable. For example, the reamer may remain deactivated at the beginning of a bitrun to drill a straight (vertical, tangent, horizontal) section or a lower dogleg curve section, then activated to allow reamer cutting structures 125*a* and 125*b* to move outward for a higher dogleg curve section. Examples of single, irreversible activation of the reamer 125 include the use of shear pins based on high differential pressure and ball drops. In other cases, a single deactivation of the reamer 125 may be acceptable. For example, once the curved section 75*b* is drilled while the reamer 125 is in the second configuration, the reamer 125 may be irreversibly deactivated to the first configuration, such that the reamer cutting structures 125*a* and 125*b* are moved inward to prevent enlargement of the wellbore 75 for the remainder of the bitrun in order to drill with lower dogleg capability. Examples of single, irreversible deactivation of the reamer 125 include the use of ball drops.

Returning to FIG. 5, in some embodiments, a control unit 270 is provided to control the BHA 85, under conditions to be described below. In one exemplary embodiment, the control unit 270 is connected to, and/or disposed within, the rotary steerable tool 90, although it may be located anywhere along the BHA 85. In one exemplary embodiment, the control unit 270 includes one or more measurement-while-drilling (MWD) systems, one or more logging-while-drilling (LWD) systems, and/or any combination thereof. In one exemplary embodiment, the control unit 270 includes one or more processors 270*a*, a memory or computer readable medium 270*b* operably coupled to the one or more processors 270*a*, and a plurality of instructions stored in the computer readable medium 270*b* and executable by the one or more processors 270*a*. A surface control unit or system 275 is in two-way communication with the control unit 270. In one exemplary embodiment, the surface control system 275 includes one or more processors 275*a*, a memory or computer readable medium 275*b* operably coupled to the one or more processors 275*a*, and a plurality of instructions stored in the computer readable medium 275*b* and executable by the one or more processors 275*a*. During operation, the control unit 270 positioned in the wellbore 75 communicates with the surface control system 275, sending directional survey information to the surface control system 275 using a telemetry system. The telemetry system may utilize mud-pulse telemetry or the like. In any event, the control unit 270 may transmit to the surface control system 275 information about the direction, inclination and orientation of the BHA 85. In one exemplary embodiment, the surface control system 275 controls the BHA 85 via the control unit 270. During operation and when the reamer 125 is operably coupled to the control unit 270 such that the control unit 270 controls the actuation of the reamer cutting structures 125*a* and 125*b*, the control unit 270 actuates the reamer cutting structures 125*a* and 125*b* to place the reamer 125 in the first configuration, the second configuration, third configuration that is different from both the first and second configuration and that also enlarges the diameter of the wellbore 75, back to the first configuration, and back to the second configuration, or any combination thereof. That is, the reamer 125 may have a variety of configurations that correspond with a variety of wellbore diameters. In one exemplary embodiment, one or both of the control unit 270 and the surface control system 275 are part of a downlink system that allows for automatic steering along a fixed or preprogrammed trajectory towards the desired target location in the formation 20. In one exemplary embodiment, to control the BHA 85 using the surface control system 275 and/or the control unit 270, the one or more processors 270*a* and/or the one or more processors 275*a* execute the plurality of instructions stored in the computer readable medium 270*b* and/or the plurality of instructions stored in the computer readable medium 275*b*.

In an exemplary embodiment, creating a straight section or a generally straight section of the wellbore includes creating a section of the wellbore that is intended to be straight but includes some deviations.

In an exemplary embodiment, the steps 205, 210, and 215 may occur in any order.

In several exemplary embodiments, the method 200 may be implemented in whole or in part by a computer. The plurality of instructions stored on the computer readable medium 270*b*, the plurality of instructions stored on the computer readable medium 275*b*, a plurality of instructions stored on another computer readable medium, and/or any combination thereof, may be executed by a processor to cause the processor to carry out or implement in whole or in part the method 200, and/or to carry out in whole or in part the above-described operation of the BHA 85. In several exemplary embodiments, such a processor may include the one or more processors 270*a*, the one or more processors 275*a*, one or more additional processors, and/or any combination thereof.

Thus, a method has been described. Embodiments of the method may generally include drilling a wellbore along a trajectory using a bit; reaming the diameter of a portion of the drilled wellbore to enlarge the portion of the wellbore; and altering the trajectory of the bit by applying a lateral force to the enlarged diameter wellbore. For any of the foregoing embodiments, the method may include any one of the following elements, alone or in combination with each other:

- Reducing a negative tilt angle that is defined between a longitudinal axis of the bit and a longitudinal axis of the wellbore.
- Reducing the negative tilt angle includes bending a longitudinally extending flexible collar that is coupled between a rotary steerable system and a drill string, wherein the flexible collar has a lower bending stiffness than the rotary steerable system.
- Bending the longitudinally extending flexible collar reduces a bending moment exerted on the rotary steerable system.
- Reducing the negative tilt angle increases a dogleg of the wellbore.

Simultaneously drilling the wellbore using the bit such that the wellbore has an original diameter; applying the lateral force to the original diameter wellbore; and displacing a portion of a longitudinally extending flexible collar when the flexible collar is positioned in the original diameter wellbore, to create a first curved section of the wellbore having a first radius of curvature.

Simultaneously drilling the wellbore, reaming the diameter of the portion of the drilled wellbore to enlarge the portion of the wellbore, applying the lateral force to the enlarged diameter wellbore, and displacing the portion of the longitudinally extending flexible collar when the flexible collar is positioned in the enlarged diameter wellbore, to create a second curved section of the wellbore that has a second radius of curvature that is less than the first radius of curvature.

Drilling the wellbore along the trajectory using the bit, reaming the diameter of the portion of the drilled wellbore to enlarge the portion of the wellbore, and altering the trajectory of the bit by applying the lateral force to the enlarged diameter wellbore occur simultaneously to steer the bit.

Creating a positive tilt angle that is defined between the longitudinal axis of the bit and the longitudinal axis of the wellbore.

Thus, a method has been described. Embodiments of the method may generally include extending a drilled wellbore while simultaneously reaming a portion of the drilled wellbore; and continuing to extend the wellbore while simultaneously applying a lateral force to the reamed portion of the drilled wellbore. For any of the foregoing embodiments, the method may include any one of the following elements, alone or in combination with each other:

Bending, within the reamed portion of the wellbore, a longitudinally extending flexible collar that is coupled between a rotary steerable system and a drill string, wherein the flexible collar has a lower bending stiffness than the rotary steerable system.

Reducing a bending moment exerted on at least a portion of a bottom hole assembly that extends within the reamed portion of the drilled wellbore.

Extending a drilled wellbore such that the wellbore has an original diameter while simultaneously applying a lateral force to the original diameter wellbore via a rotary steerable system.

Applying the lateral force to the original diameter wellbore via the rotary steerable system results in a first negative tilt angle defined by a longitudinal axis of the bit and a longitudinal axis of the wellbore.

Applying the lateral force to the enlarged diameter wellbore results in a second negative tilt angle defined by the longitudinal axis of the bit and the longitudinal axis of the wellbore; and wherein the second negative tilt angle is less than the first negative tilt angle.

Reaming a portion of the drilled wellbore includes radially extending a cutting structure in a direction perpendicular to a longitudinal axis of a reamer from a retracted position such that an outermost diameter of the reamer is greater than an outer dimension of the bit.

A rotary steerable system is coupled to a drill string that extends within the wellbore; wherein the method further includes allowing lateral displacement of a portion of the rotary steerable system within the reamed portion of the drilled wellbore to reduce a negative tilt angle of the bit; and wherein the negative tilt angle is defined by a longitudinal axis of the bit and a longitudinal axis of the wellbore.

The bit and the rotary steerable system form a portion of a push-the-bit bottom hole assembly and wherein enlarging the diameter of the wellbore increases a dogleg capability associated with the push-the-bit bottom hole assembly.

Thus, a push-the-bit bottom hole assembly has been described. Embodiments of the push-the-bit bottom hole assembly may generally include a bit; a rotary steerable system coupled to the bit, wherein the rotary steerable system includes an actuator that extends radially in a direction perpendicular to a longitudinal axis of the rotary steerable system to exert a lateral force on the bit; and a reamer positioned between a portion of the bit and a portion of the rotary steerable system. For any of the foregoing embodiments, the method may include any one of the following elements, alone or in combination with each other:

A longitudinally extending flexible collar, wherein the rotary steerable system is positioned between the longitudinally extending flexible collar and the bit, and wherein the flexible collar has a lower bending stiffness than the rotary steerable system.

The reamer is a multi-actuation reamer.

The reamer is movable between a first configuration and a second configuration; wherein, when in the first configuration, a cutting structure that is capable of extending radially in a direction perpendicular to a longitudinal axis of the reamer is retracted; wherein, when in the second configuration, the cutting structure is radially extended to form an outermost diameter of the reamer; and wherein, when in the second configuration, the outermost diameter of the reamer is greater than an outer diameter of the bit.

When in the first configuration, the push-the-bit bottom hole assembly has a first maximum dogleg capability.

When in the second configuration, the push-the-bit bottom hole assembly has a second maximum dogleg capability that is greater than the first maximum dogleg capability.

Thus, a method has been described. Embodiments of the method may generally include extending a wellbore using a drill bit; enlarging a diameter of the wellbore using a tool; and applying a lateral force to a rotary steerable tool when the rotary steerable tool is positioned in the enlarged diameter wellbore using a pad that extends radially from the rotary steerable tool; wherein the tool, the rotary steerable tool, and the drill bit are coupled together such that the tool is positioned between a portion of the drill bit and a portion of the rotary steerable tool. For any of the foregoing embodiments, the method may include any one of the following elements, alone or in combination with each other:

Reducing a negative tilt angle that is defined between a longitudinal axis of the drill bit and a longitudinal axis of the wellbore.

Reducing the negative tilt angle comprises bending a longitudinally extending flexible collar that is coupled between the rotary steerable tool and a drill string, wherein the flexible collar has a lower bending stiffness than the rotary steerable tool.

Bending the longitudinally extending flexible collar reduces a bending moment exerted on the rotary steerable tool.

Simultaneously extending the wellbore using the drill bit such that the wellbore has an original diameter; applying the lateral force to the rotary steerable tool when the rotary steerable tool is positioned in the original diameter wellbore; and displacing a portion of a longitudinally extending flexible collar, when the flexible collar is positioned in the original diameter wellbore, to create a first curved section of the wellbore having a first radius of curvature; and simultaneously extending the wellbore using the drill bit, applying the lateral force to the rotary steerable tool when the rotary steerable tool is positioned in the enlarged diameter wellbore, and displacing the portion of the longitudinally extending flexible collar, when the flexible collar is positioned in the enlarged diameter wellbore, to create a second curved section of the wellbore that has a second radius of curvature that is less than the first radius of curvature; wherein the flexible collar is coupled between the drill bit and a drill string.

Extending the wellbore using the drill bit, enlarging the diameter of the wellbore, and applying the lateral force to the rotary steerable tool when the rotary steerable tool is positioned in the enlarged diameter wellbore occur simultaneously to steer the drill bit.

The tool is a reamer and enlarging the diameter of the wellbore comprises activating the reamer.

Deactivating the reamer.

Creating a positive tilt angle that is defined between a longitudinal axis of the drill bit and a longitudinal axis of the wellbore.

Thus, a method has been described. Embodiments of the method may generally include extending a wellbore, using a drill bit and a rotary steerable tool comprising a pad that extends in a radial direction, while simultaneously enlarging a diameter of the wellbore using a reamer positioned between a portion of the drill bit and a portion of the rotary steerable tool. For any of the foregoing embodiments, the method may include any one of the following elements, alone or in combination with each other:

Applying a lateral force to the rotary steerable tool when the rotary steerable tool is positioned in the enlarged diameter wellbore using the pad.

Bending, within the enlarged diameter wellbore, a longitudinally extending flexible collar that is coupled between the rotary steerable tool and a drill string, wherein the flexible collar has a lower bending stiffness than the rotary steerable tool.

Bending, within the enlarged diameter wellbore, the longitudinally extending flexible collar reduces a bending moment exerted on the rotary steerable tool.

Extending the wellbore, using the drill bit and the rotary steerable tool, such that the wellbore has an original diameter while simultaneously applying a lateral force to the rotary steerable tool when the rotary steerable tool is positioned in the original diameter wellbore.

Applying the lateral force to the rotary steerable tool when the rotary steerable tool is positioned in the original diameter wellbore results in a first negative tilt angle defined by a longitudinal axis of the drill bit and a longitudinal axis of the wellbore.

Applying the lateral force to the rotary steerable tool when the rotary steerable tool is positioned in the enlarged diameter wellbore results in a second negative tilt angle defined by the longitudinal axis of the drill bit and the longitudinal axis of the wellbore.

The second negative tilt angle is less than the first negative tilt angle.

The reamer is movable between a first configuration and a second configuration.

When in the first configuration, a cutting structure that is capable of extending radially in a direction perpendicular to a longitudinal axis of the reamer is retracted.

When in the second configuration, the cutting structure is radially extended to form an outermost diameter of the reamer.

When in the second configuration, the outermost diameter of the reamer is greater than an outer dimension of the drill bit.

The rotary steerable tool is coupled to a drill string that extends within the wellbore.

Allowing a lateral displacement of a portion of the rotary steerable tool within the enlarged diameter wellbore to reduce a negative tilt angle of the drill bit in a drilling direction.

The negative tilt angle is defined by a longitudinal axis of the drill bit and a longitudinal axis of the wellbore.

The drill bit and the rotary steerable tool form a portion of a push-the-bit bottom hole assembly and wherein enlarging the diameter of the wellbore increases a dogleg capability associated with the push-the-bit bottom hole assembly.

Thus, a push-the-bit bottom hole assembly has been described. Embodiments of the push-the-bit bottom hole assembly may generally include a drill bit; a rotary steerable tool coupled to the drill bit, wherein the rotary steerable tool comprises a pad that extends radially in a direction perpendicular to a longitudinal axis of the rotary steerable tool to exert a lateral force on the drill bit; and a reamer positioned between a portion of the drill bit and a portion of the rotary steerable tool. For any of the foregoing embodiments, the method may include any one of the following elements, alone or in combination with each other:

The reamer is a multi-actuation reamer.

The reamer is movable between a first configuration and a second configuration; wherein, when in the first configuration, a cutting structure that is capable of extending radially in a direction perpendicular to a longitudinal axis of the reamer is retracted; wherein, when in the second configuration, the cutting structure is radially extended to form an outermost diameter of the reamer; and wherein, when in the second configuration, the outermost diameter of the reamer is greater than an outer diameter of the drill bit.

A longitudinally extending flexible collar, wherein the rotary steerable tool is positioned between the longitudinally extending flexible collar and the drill bit, and wherein the flexible collar has a lower bending stiffness than the rotary steerable tool.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

It is understood that variations may be made in the foregoing without departing from the scope of the disclosure. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method for constructing a wellbore, comprising:

drilling a wellbore along a trajectory using a bit;

reaming the diameter of a portion of the drilled wellbore to enlarge the portion of the wellbore; and using a rotary steerable system coupled to the bit, wherein the rotary steerable system comprises a plurality of actuators configured to independently and selectively extend radially in a direction perpendicular to a longitudinal axis of the rotary steerable system, altering the trajectory of the bit by applying a lateral force to the enlarged diameter wellbore.

2. The method of claim 1, further comprising reducing a negative tilt angle that is defined between a longitudinal axis of the bit and a longitudinal axis of the wellbore.

3. The method of claim 2, wherein reducing the negative tilt angle comprises bending a longitudinally extending flexible collar that is coupled between the rotary steerable system and a drill string, wherein the flexible collar has a lower bending stiffness than the rotary steerable system.

4. The method of claim 3, wherein bending the longitudinally extending flexible collar reduces a bending moment exerted on the rotary steerable system.

5. The method of claim 2, wherein reducing the negative tilt angle increases a dogleg of the wellbore.

6. The method of claim 2, further comprising creating a positive tilt angle that is defined between the longitudinal axis of the bit and the longitudinal axis of the wellbore.

7. The method of claim 1, further comprising:

simultaneously drilling the wellbore using the bit such that the wellbore has an original diameter; applying the lateral force to the original diameter wellbore; and displacing a portion of a longitudinally extending flexible collar, when the flexible collar is positioned in the original diameter wellbore, to create a first curved section of the wellbore having a first radius of curvature; and simultaneously drilling the wellbore, reaming the diameter of the portion of the drilled wellbore to enlarge the portion of the wellbore, applying the lateral force to the enlarged diameter wellbore, and displacing the portion of the longitudinally extending flexible collar when the flexible collar is positioned in the enlarged diameter wellbore, to create a second curved section of the wellbore that has a second radius of curvature that is less than the first radius of curvature;

wherein the flexible collar is coupled between the bit and a drill string.

8. The method of claim 1, wherein drilling the wellbore along the trajectory using the bit, reaming the diameter of the portion of the drilled wellbore to enlarge the portion of the wellbore, and altering the trajectory of the bit by applying the lateral force to the enlarged diameter wellbore occur simultaneously to steer the bit.

9. A method for constructing a wellbore, the method comprising extending a drilled wellbore while simultaneously reaming a portion of the drilled wellbore; and continuing to extend the wellbore while simultaneously applying a lateral force to the reamed portion of the drilled wellbore;

wherein applying the lateral force comprises using a rotary steerable system comprising a plurality of actuators configured to independently and selectively extend radially in a direction perpendicular to a longitudinal axis of the rotary steerable system.

10. The method of claim 9, further comprising bending, within the reamed portion of the wellbore, a longitudinally extending flexible collar that is coupled between the rotary steerable system and a drill string, wherein the flexible collar has a lower bending stiffness than the rotary steerable system.

11. The method of claim 9, further comprising reducing a bending moment exerted on at least a portion of a bottom hole assembly that extends within the reamed portion of the drilled wellbore.

12. The method of claim 11, further comprising extending a drilled wellbore using a bit and the rotary steerable system, such that the drilled wellbore has an original diameter while simultaneously applying a lateral force to the original diameter wellbore via the rotary steerable system;

wherein applying the lateral force to the original diameter wellbore via the rotary steerable system results in a first negative tilt angle defined by a longitudinal axis of the bit and a longitudinal axis of the wellbore;

wherein applying the lateral force to the enlarged diameter wellbore results in a second negative tilt angle defined by the longitudinal axis of the bit and the longitudinal axis of the wellbore; and wherein the second negative tilt angle is less than the first negative tilt angle.

13. The method of claim 12, wherein reaming a portion of the drilled wellbore comprises radially extending a cutting structure in a direction perpendicular to a longitudinal axis of a reamer from a retracted position such that an outermost diameter of the reamer is greater than an outer dimension of the bit.

14. The method of claim 9, wherein the rotary steerable system is coupled to a drill string that extends within the wellbore;

wherein the method further comprises allowing lateral displacement of a portion of the rotary steerable system within the reamed portion of the drilled wellbore to reduce a negative tilt angle of a bit; and wherein the negative tilt angle is defined by a longitudinal axis of the bit and a longitudinal axis of the wellbore.

15. The method of claim 14, wherein the bit and the rotary steerable system form a portion of a push-the-bit bottom hole assembly and wherein enlarging the diameter of the wellbore increases a dogleg capability associated with the push-the-bit bottom hole assembly.

16. A push-the-bit bottom hole assembly, comprising:

a bit;

a rotary steerable system coupled to the bit, wherein the rotary steerable system comprises a plurality of actuators configured to independently and selectively extend radially in a direction perpendicular to a longitudinal axis of the rotary steerable system to exert a lateral force on the bit; and a reamer positioned between a portion of the bit and a portion of the rotary steerable system.

17. The push-the-bit bottom hole assembly of claim 16, further comprising a longitudinally extending flexible collar, wherein the rotary steerable system is positioned between the longitudinally extending flexible collar and the bit, and wherein the flexible collar has a lower bending stiffness than the rotary steerable system.

18. The push-the-bit bottom hole assembly of claim 16, wherein the reamer is a multi-actuation reamer.

19. The push-the-bit bottom hole assembly of claim 16, wherein the reamer is movable between a first configuration and a second configuration;

wherein, when in the first configuration, a cutting structure that is capable of extending radially in a direction perpendicular to a longitudinal axis of the reamer is retracted;

wherein, when in the second configuration, the cutting structure is radially extended to form an outermost diameter of the reamer; and wherein, when in the second configuration, the outermost diameter of the reamer is greater than an outer diameter of the bit.

20. The push-the-bit bottom hole assembly of claim 19, wherein, when in the first configuration, the push-the-bit bottom hole assembly has a first maximum dogleg capability; and wherein, when in the second configuration, the push-the-bit bottom hole assembly has a second maximum dogleg capability that is greater than the first maximum dogleg capability.

* * * * *